US008142186B2

(12) United States Patent
Nilsson et al.

(10) Patent No.: US 8,142,186 B2
(45) Date of Patent: Mar. 27, 2012

(54) ARRANGEMENT FOR PREPARATION OF A FUEL FOR COMBUSTION

(75) Inventors: Ulf Nilsson, Whetstone (GB); Peter Senior, Levittown, PA (US)

(73) Assignee: Siemens Aktiengesellschaft, Munich (DE)

( * ) Notice: Subject to any disclaimer, the term of this patent is extended or adjusted under 35 U.S.C. 154(b) by 847 days.

(21) Appl. No.: 11/992,336

(22) PCT Filed: Aug. 16, 2006

(86) PCT No.: PCT/EP2006/065353

§ 371 (c)(1),
(2), (4) Date: Mar. 20, 2008

(87) PCT Pub. No.: WO2007/033876

PCT Pub. Date: Mar. 29, 2007

(65) Prior Publication Data

US 2009/0170043 A1 Jul. 2, 2009

(30) Foreign Application Priority Data

Sep. 24, 2005 (GB) ..... 0519520.1

(51) Int. Cl.
*F23D 11/44* (2006.01)
*F23L 15/00* (2006.01)

(52) U.S. Cl. ..... 431/246; 431/11; 431/241; 431/242

(58) Field of Classification Search ..... 431/246, 431/242, 241, 240, 11, 354, 215, 182
See application file for complete search history.

(56) References Cited

U.S. PATENT DOCUMENTS

| | | | | |
|---|---|---|---|---|
| 3,307,355 | A | 3/1967 | Bahr | |
| 3,618,317 | A * | 11/1971 | Du Bell | 60/737 |
| 4,083,353 | A * | 4/1978 | Petry | 126/21 R |
| 4,856,982 | A * | 8/1989 | Olson | 431/20 |
| 5,033,957 | A | 7/1991 | Gerstmann et al. | |
| 5,062,792 | A * | 11/1991 | Maghon | 431/284 |
| 5,247,792 | A | 9/1993 | Coffinberry | |
| 5,891,584 | A | 4/1999 | Coffinberry | |
| 6,155,821 | A * | 12/2000 | Hellum | 431/354 |
| 6,461,148 | B1 * | 10/2002 | Scotto et al. | 431/215 |
| 6,808,816 | B2 * | 10/2004 | Mancini et al. | 428/469 |

FOREIGN PATENT DOCUMENTS

| | | | |
|---|---|---|---|
| EP | 0 095 555 A2 | | 7/1983 |
| FR | 2 254 244 | | 7/1975 |
| FR | 2254244 | * | 7/1975 |
| GB | 446050 | | 4/1936 |
| GB | 1 294 480 | | 10/1972 |
| GB | 1 479 686 | | 7/1977 |
| JP | 61119911 A | * | 6/1986 |

* cited by examiner

*Primary Examiner* — Kenneth Rinehart
*Assistant Examiner* — Chuka C Ndubizu

(57) ABSTRACT

The invention relates to an arrangement for preparation of a fuel for combustion including a burner, a combustion chamber associated with the burner and in which combustion of a fuel is to take place in use of the arrangement as well as means for supplying liquid fuel to the arrangement through an internal passage in the burner for said combustion, solid portions of the burner body being heated by said combustion in use of the arrangement, wherein said internal passage is located inside said solid portions of the burner body for receiving heat energy evaporating said fuel from these body portions, and that it comprises means for conveying vaporized fuel to the combustion chamber to take part in the combustion.

16 Claims, 7 Drawing Sheets

ARRANGEMENT FOR PREPARATION OF A FUEL FOR COMBUSTION

CROSS REFERENCE TO RELATED APPLICATIONS

This application is the US National Stage of International Application No. PCT/EP2006/065353, filed Aug. 16, 2006 and claims the benefit thereof. The International Application claims the benefits of British application No. 0519520.1 filed Sep. 24, 2005, both of the applications are incorporated by reference herein in their entirety.

FIELD OF THE INVENTION

The present invention relates to an arrangement for preparation of a fuel for combustion including a burner, a combustion chamber associated with the burner and in which combustion of a fuel is to take place in use of the arrangement as well as means for supplying liquid fuel to the arrangement through an internal passage in the burner for said combustion, solid portions of the burner body being heated by said combustion in use of the arrangement.

This arrangement may be designed for preparation of a fuel for combustion in a burner in various heating applications, for example for producing steam and hot water, such as in different types of boilers used in process industries or district heating plants. Such an arrangement is also used in gas turbine engines, and this particular application of the invention will primarily be discussed hereinafter for illuminating the invention and the problems to be solved thereby but not in any way restricting the scope of the invention.

BACKGROUND OF THE INVENTION

In common to all such burners is the demand by environmental authorities for increasingly low emissions of primarily $NO_x$. The key issue for obtaining low emissions of $NO_x$ and other pollutants is to obtain a sufficient distribution and evaporation of said liquid fuel in the combustion process avoiding hot spots resulting in higher emissions of $NO_x$ as well as spots with combustion at too low temperatures resulting in high emissions of CO. The main task of an arrangement for preparation of a fuel as defined in the introduction is therefore to provide a sufficiently uniform distribution of the fuel by evaporation thereof before the fuel is mixed with air/oxidant. However, in some cases a "defined" or "controlled" non-uniform distribution may also be accepted where a $NO_x$/turndown trade-off would be a possible solution.

Different ways have so far been chosen for obtaining this. Water or steam has been injected in combination with the liquid fuel in particular to limit the flame temperature and as a secondary effect to produce a more refined spray. Another way to proceed has been to utilize a higher feed pressure of the fuel obtaining a well atomized spray and increasing the time for mixing/evaporation from the injection point to combustion. A third route has been to convert the liquid fuel to a gas in a separate reactor using steam or combustion in oxygen poor environments.

The alternative last mentioned appears to be the most attractive one from the point of view of obtaining low emissions of $NO_x$, since it is easier to obtain a homogenous mixture of air and fuel when starting the mixing process by mixing air and a gas as fuel than air and atomized liquid fuel to be evaporated. The hot gas fuel can be better distributed throughout the entire amount of air, so that lower temperature combustion results and by that lower emissions of $NO_x$.

Moreover, possible combustion of not evaporated and/or unmixed liquid fuel will also result in higher emissions of $NO_x$.

Russian patent document 2106574 discloses a said arrangement in which a pipe containing liquid fuel is exposed to hot combustion gases in a space in which the flame of the burner is located evaporating the fuel inside the pipe. The hot gas fuel is then mixed with air and conveyed into said space for combustion. A disadvantage of this arrangement is that as a consequence of the thin pipe walls, very hot zones of the pipe will result, which involves a risk of coking of the fuel producing deposits on the internal walls of the pipe. Furthermore, the pipe is unprotected and exposed to corrosion and wear, so that the lifetime thereof will be limited. There is also risk of occurrence of vibrations of the pipe extending freely in said space. Furthermore, it is difficult to control the heating and evaporation of the liquid fuel, since the thin walls of the pipe are very sensitive to changes of the operation conditions of the burner.

SUMMARY OF THE INVENTION

The object of the present invention is to provide an arrangement of the type defined in the introduction that is improved in at least some respect compared to such arrangements already known.

This object is according to the invention achieved by providing such an arrangement in which said internal passage is located inside said solid portions of the burner body for receiving heat energy evaporating said fuel from these body portions, and which comprises means for conveying the vaporized fuel to the combustion chamber to take part in the combustion.

It has been realized that heat absorbed by such solid portions of the burner body during combustion results in the temperature of these portions being well suited for evaporation of liquid fuel. This means that liquid fuel requiring less pumping capacity for raising it to injection pressure than gas fuel may be fed to the burner and in spite of that low emissions of $NO_x$ are possible thanks to the advantageous evaporation of the liquid fuel passing through said internal passage. The conversion of liquid fuel to gas fuel takes place efficiently close to the combustion chamber. Such solid portions of the burner body will not be heated to such high temperatures as those prevailing close to the flame in the combustion chamber reducing the risk of coking of the fuel inside said internal passage, and the solid portions of the burner body will not be that sensitive to changes in the operating conditions of the burner, so that temperature changes thereof will be slow. This means that control of the evaporation process will not be overly sensitive and may be accomplished reliably.

Another advantage of evaporating the liquid fuel in an air free integrated part of the burner is the elimination of any risk of fire in the fuel conduits.

According to a preferred embodiment of the invention said internal passage extends according to a prolonged path inside said solid burner body portions thereby to increase the surface area of the walls of the passage to enhance heat exchange with the fuel. Such a path improves the likelihood of obtaining evaporation of all the liquid fuel flowing through the passage. The prolongation may for instance be obtained by arranging for at least a portion of the internal passage to follow a path that spirals inwardly.

According to another embodiment of the invention said burner body is designed to be allowed to be split into at least two parts at a location enabling inspection and/or cleaning of surfaces of said internal passage. According to another embodiment at least one of said at least two parts is removable from the rest of the burner body for exposing said internal passage for enabling inspection and/or cleaning thereof, and said supply means is connected to a part of the burner body other than said at least one removable part. This means that no disconnection of said means for supplying fuel to the burner has to be performed for enabling inspection and/or cleaning of said internal passage, simplifying the maintenance and making it less costly and possible to be carried out more frequently.

According to another embodiment of the invention the arrangement comprises an insert member which participates in forming said internal passage and is removably inserted in said solid portions of the burner body. Accordingly, inspection and/or cleaning of said internal passage may be facilitated by removing the entire insert from the rest of the burner. It is also possible to replace the insert by another during said maintenance thereby reducing the time for which the burner is out of service. In this arrangement, it is preferred that said supply means is connected to said solid portions of the burner body and through these to said internal passage thereby to allow removal of said insert member from the burner body without disturbing the connection of the supply means to the burner body. This further reduces the time for which the burner is out of service. Furthermore, different evaporation times and fuel temperatures can be achieved by exchange of the insert member and the length of the passage machined in the insert member.

According to another embodiment of the invention said internal passage is within a member of said burner body that forms by an end face thereof a base of a space in which the flame of the burner is located, the flame extending from the base towards said combustion chamber. Such a part of the burner body is well suited to evaporating liquid fuel, since its temperature, from heat energy received from the flame, is within a range well suited to the evaporation. Furthermore, the temperature of said member will change slowly, so that other devices for controlling different members (such as valves and the like in the power plant or the like in which the burner is arranged) may easily adapt such control to the temperature change of said member. The temperature of said burner body member decreases the greater the distance from said space. The path chosen for said internal passage may take this into account. The path chosen may also take into account the evaporation temperature of the particular liquid fuel to be used in the burner. It is pointed out that other solid portions of the burner may also be used to accommodate said internal passage. For example, there could be used guide vanes or other members that surround the space containing the burner flame. It is also possible for the arrangement to have more than one said internal passage, such as one extending through said burner body member and one through the guide vanes or other members surrounding said space.

According to another embodiment of the invention in which said internal passage is within said burner body member, said conveying means comprises an opening of said internal passage in said end face for injecting by an injector means a part of the evaporated fuel into said space. The burner body member may then belong to a pilot burner part of said burner, which will then inject a gas fuel instead of liquid fuel into said space resulting in substantially lower emissions of $NO_x$ emanating from the pilot fuel, which emissions constitute a considerable part of the emissions at start up of the burner and at low load operation.

According to another embodiment of the invention said conveying means is adapted to convey at least a part of said fuel evaporated in said internal passage to said space through openings into said space at locations circumferentially distributed around said space. Such location of said openings is advantageous for obtaining a homogenous mixture of fuel and air in said combustion space. The circumferentially distributed openings may be arranged in said end face and/or in lateral burner walls surrounding said space having said end face as base.

According to another embodiment of the invention the arrangement comprises pilot gas injecting members arranged circumferentially distributed around said burner space, and said conveying means is adapted to convey at least a part of said fuel evaporated in said internal passage to said space through said pilot gas injecting members. It may be that the fuel evaporated in said internal passage is the only gas fuel entering said space through said pilot gas injecting members. Thus, no separate supply is necessary for said pilot gas injecting members, and these are fully supplied with gas fuel by means of the liquid fuel supplied to said internal passage.

According to another embodiment of the invention the arrangement comprises main gas injecting members arranged adjacent to said burner space, and said conveying means is adapted to convey at least a part of said fuel evaporated in said internal passage to said space through said main gas injecting members. This means that liquid fuel which is easier to pump may be used to feed the main gas injecting members with gas fuel.

According to another embodiment of the invention said main gas injecting members are arranged circumferentially distributed around said burner space and/or axially distributed along said burner space. Such distribution is advantageous for obtaining a homogenous mixture of the gas fuel with air when using known so-called swirlers for burners, especially in gas turbine engines. According to another embodiment of the invention said conveying means is adapted to convey at least a part of said fuel evaporated in said internal passage as the only gas fuel to enter said space through said main gas injecting members, thereby simplifying the construction of the burner.

According to another embodiment of the invention said conveying means is adapted to convey at least a part of said fuel evaporated in said internal passage as the main fuel supply for said combustion to said burner space using said distributed openings. It is advantageous when said conveying means is adapted to convey at least a part of said fuel evaporated in said internal passage as the only fuel for said main fuel supply, so that the burner only has to be fed with said liquid fuel and yet obtains a sufficiently homogenous mixture of gas fuel and air to achieve low emissions of $NO_x$.

According to another embodiment of the invention the arrangement comprises a temperature sensor adapted to measure the temperature of said solid burner body portions at least one location, a valve means communicating with said internal passage, and a control unit adapted to, upon start up of the arrangement, keep said valve means closed for injecting substantially all said fuel passing through said internal passage into said space through said injector means, and, when receiving information from said sensor that the temperature has exceeded a predetermined level, open said valve means to convey at least a part of said fuel evaporated in said internal passage through said distributed openings into said burner space. This means that upon start up the fuel may be partially injected through said injector means as a liquid into said burner space using a conventional liquid atomising nozzle, and when the temperature in said solid burner portions has increased sufficiently- to produce full evaporation of the liquid fuel in the internal passage only gas fuel will be injected into the space through the injector means, and by opening the valve means this vaporized fuel may then also be used to supply the burner space using said distributed openings.

According to another embodiment of the invention said control unit is adapted to open said valve means when said temperature sensor senses a temperature above 100° C., preferably 150-400° C. The value of the predetermined temperature is dependant upon the evaporation temperature of the particular liquid fuel used and should be such that all the liquid fuel will be evaporated in said internal passage when said predetermined temperature is reached.

According to another embodiment of the invention said valve means is adapted to open and close the fuel flow path to said pilot gas injecting members, the arrangement comprises a further valve means adapted to communicate with said internal passage, and said control unit is adapted to control said further valve means to start to open at a certain load on the arrangement and to assume an opening degree varying with said load so as to convey at least a part of said fuel evaporated in said internal passage to said main gas injecting members.

According to another embodiment of the invention said internal passage extends through guide vanes or other members surrounding a space for containing the burner flame for injecting said fuel as a gas into said space. In this embodiment, the conveying means may be arranged to convey liquid fuel vaporised in said internal passage to said space as a main fuel supply in the form of gas. It is also possible to have the internal passage extend first through the guide vanes or other members for preheating said liquid fuel and then through said burner body member for complete evaporation of the fuel, which is then conveyed to said space as the main gas supply.

The arrangement may also comprise means for mixing fuel and an oxidant in the burner or combustion chamber in use of the arrangement.

According to another embodiment of the invention said supply means is adapted to supply a liquid fuel wherein all major components of the fuel have an evaporation temperature below 250° C. This means that it may be ensured that the liquid fuel will be evaporated in said solid burner body portions, since this temperature may easily be obtained in such solid burner body portions surrounding the space in which the flame of the burner is located. It is then preferred that the supplying means is adapted to supply a liquid fuel having a substantially uniform composition in the sense that the majority of the fuel's components have evaporating temperatures close to one other. Suitable fuels with a high degree of purity and low boiling point are environmentally friendly fuels, so-called bio-fuels, such as alcohols (methanol, ethanol) and dimethyl ether ($CH_3$—O—$CH_3$).

According to another embodiment of the invention said internal passage has heat transfer enhancing means, such as turbulators, for speeding up said evaporation of said liquid fuel, and at least a part of said internal passage may also be provided with a surface designed to prevent adherence of fuel components thereto, such as by being smooth and/or having a repellent coating, which may prevent deposition on the walls of the internal passage should any components of the fuel start to coke. The repellent coating may also provide corrosion protection in case the fuel and the walls of the internal passage should give rise to reduction/oxidation over time.

According to another embodiment of the invention said arrangement is designed to be part of a gas turbine engine, which is a suitable application for an arrangement of this type for obtaining low emissions of $NO_x$ during operation of the engine.

According to another embodiment of the invention the arrangement is designed to be part of a boiler for heating applications.

Further advantages as well as advantageous features of the invention appear from the following description.

BRIEF DESCRIPTION OF THE DRAWINGS

With reference to the appended drawings, below follows a specific description of embodiments of the invention cited as examples.

In the drawings.

DETAILED DESCRIPTION OF THE INVENTION

Figure 1:
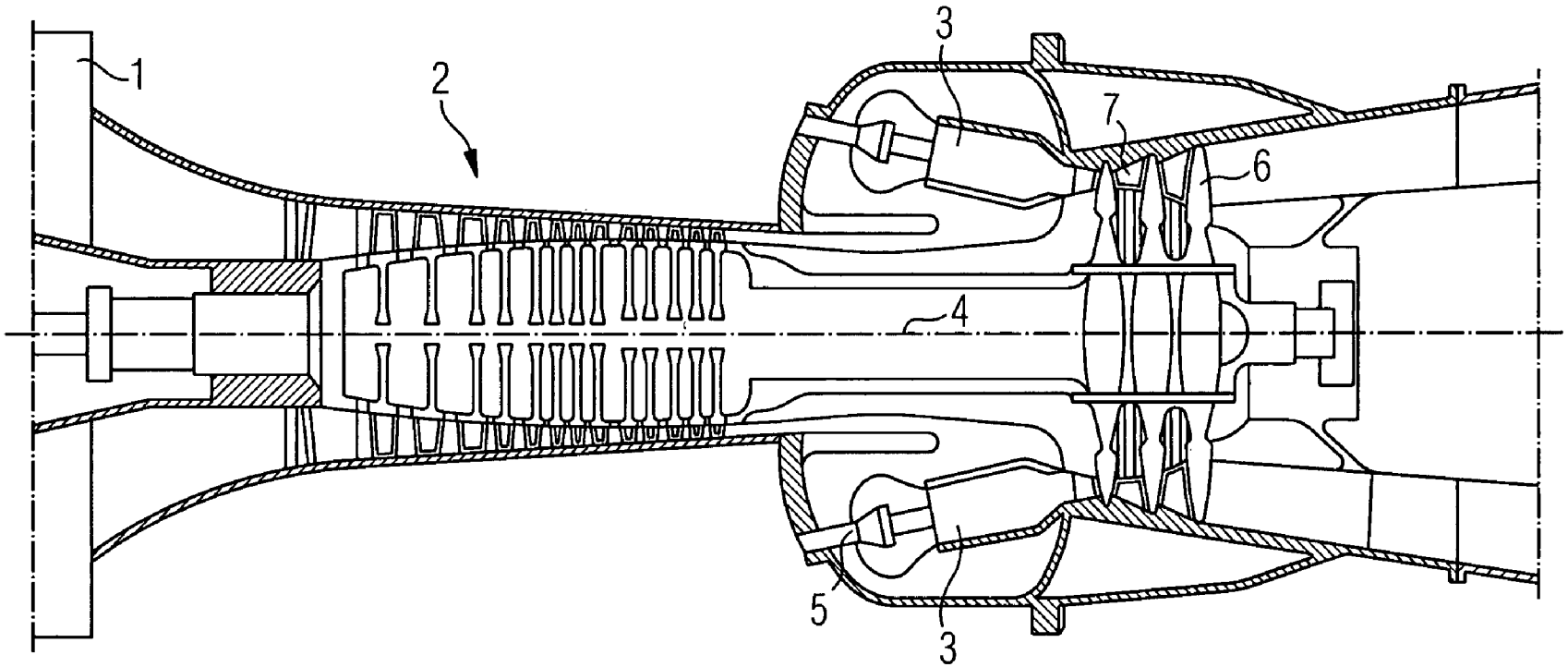
FIG. 1 is a schematic cross-sectional view through a part of a known gas turbine engine with burners, to which an arrangement for preparation of a fuel for combustion according to the present invention may be applied.

As already mentioned, the present invention is directed to an arrangement for preparation of a fuel for combustion for different applications where a liquid fuel is supplied to the burner of the arrangement, and one such application is in a gas turbine engine as used in for instance a power plant as schematically illustrated in FIG. 1. The gas turbine engine has an air inlet 1 at one end followed by a compressor 2 for compressing the air from said inlet. Combustors 3 having a can-like shell are distributed around a turbine shaft 4. Fuel is introduced into the respective combustors at 5 and is there mixed with a part of said air from the air inlet 1 for the combustion. How this actually takes place is the key issue of the present invention and will be explained further below. Hot gases resulting from the combustion drive turbine blades 6 of the turbine part of the gas turbine engine and are guided by guide vanes 7.

Figure 2:
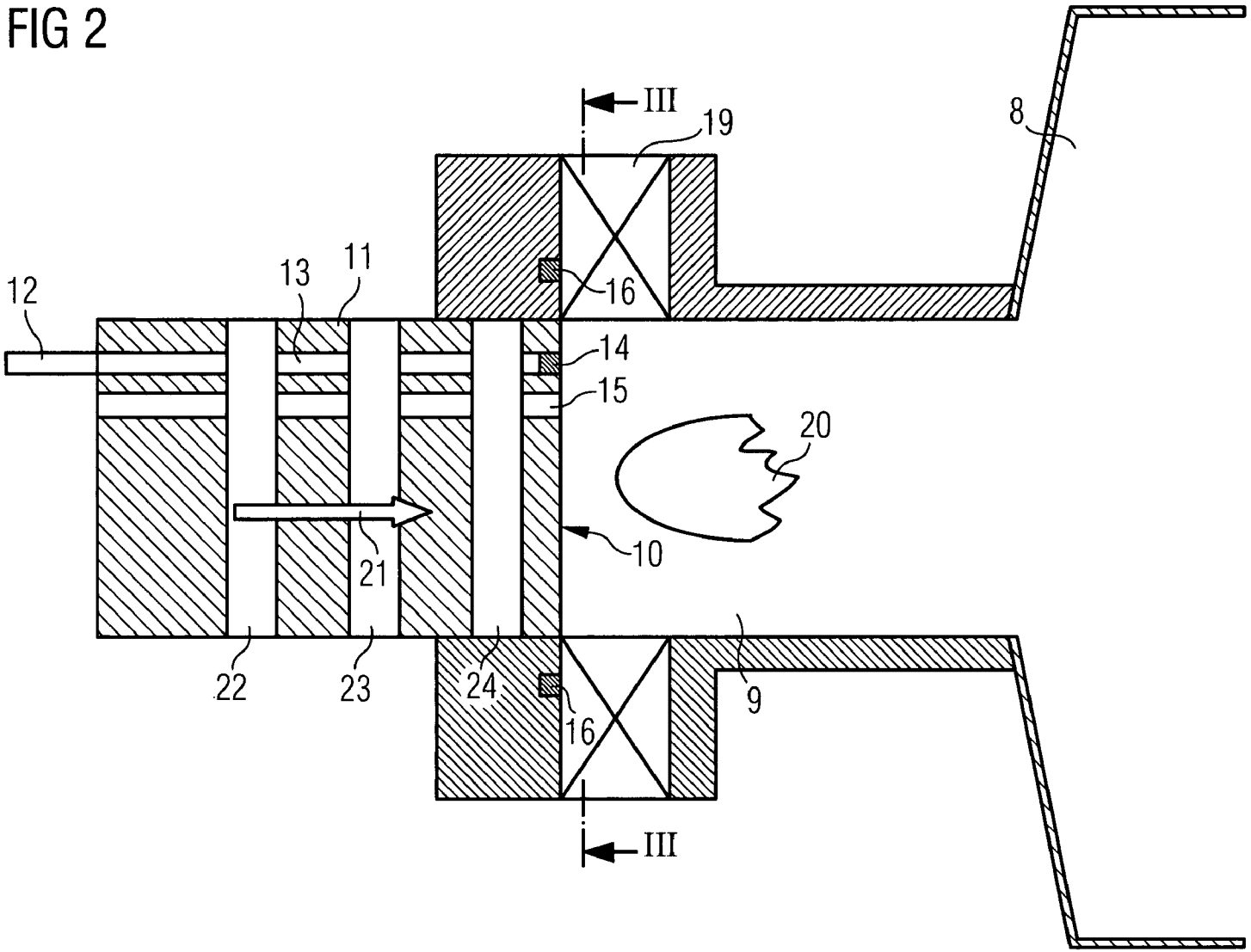
FIG. 2 is an enlarged schematic view of a burner of the type to which the present invention may be applied and is used for explaining the basic idea of the present invention.
Figure 3:
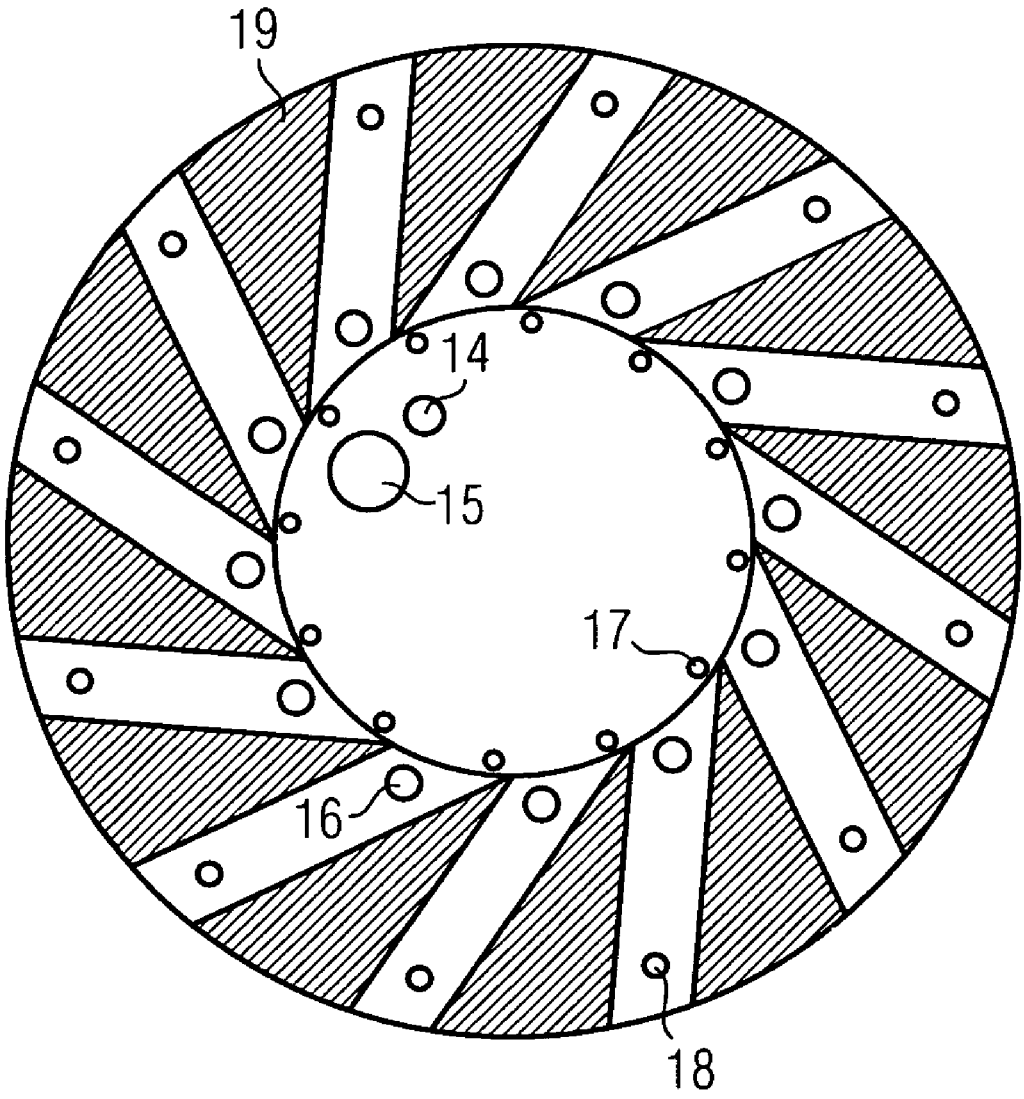
FIG. 3 is a cross-sectional view of the burner shown in FIG. 2 along the line III-III in FIG. 2.

The general function of an arrangement for preparation of a fuel for combustion for instance in a gas turbine engine of this type will now be explained with reference to FIGS. 2 and 3. The combustion chamber 8 has a burner space 9 with a base 10 formed by an end face of a solid burner body member 11. The length of this rod-like member 11, normally of metal, is dependant upon the desired heat flow from the combustion chamber and the distance to a place for fixing the burner. The object of the end face 10 is to stabilize the flame produced in the space 9 during combustion. A supplying means 12 is adapted to supply liquid fuel through an internal passage 13 inside the burner body member for said combustion. This liquid fuel is atomized and sprayed into said burner space 9 through a pilot burner injector nozzle 14. An ignition means 15 is located close to said nozzle 14 for igniting the fuel inside the burner space for commencing combustion.

Main liquid fuel nozzles 16 are circumferentially distributed around said burner space 9 for supplying to the space atomized liquid fuel for evaporation and later combustion. Pilot gas injector nozzles 17 are also distributed around the burner space 9 on face 10. Finally, a main gas fuel supply for combustion takes place at locations circumferentially distributed around the burner space 9 in the space 18 between sector-shaped guide vanes 19 which guide air from the compressor into said burner space while mixing it with said main gas fuel. This mixing will result in a sufficiently homogenous mixture of gas fuel and air to obtain a steady combustion process thanks to the so-called radial swirler arrangement used for this.

The flame 20 established in the burner space 9 in operation of the arrangement will heat the solid burner body member 11, so that a temperature gradient is developed therein along the length of this member, which means that the temperature will increase in the direction of the arrow 21. The present invention is based on the use of the heating by the flame of solid burner body portions for evaporating liquid fuel supplied to the arrangement for obtaining lower emissions of $NO_x$ from said combustion. This is contrary to earlier attempts to avoid evaporation in the liquid fuel channel inside the member 11 for preventing deposits occurring on the channel walls.

Depending on the boiling point or evaporation temperature of the liquid fuel used and the super-heating required, different sections, as illustrated by 22-24, of the solid burner body member 11 may be used to achieve the evaporation. Liquid fuels wherein all major components of the fuel have an evaporation temperature below 250° C. are suitable fuels to use, since the temperature range in member 11 is typically 100-400° C. Suitable fuels are high-quality liquid hydrocarbon fuels, alcohols, such as methanol or ethanol, and dimethyl ether. It is pointed out that although dimethyl ether is a gas at atmospheric pressure, it is a liquid at pressures above approx. 5 bar, which is the pressure required for injection in a gas turbine. The liquid fuel should be of a quality that prevents deposits on the walls of internal passage 13 when evaporated. The internal passage 13 for the liquid fuel inside the member 11 preferably extends according to a prolonged path for increasing the surface area of walls of the passage for enhancing heat exchange with the fuel, see arrow 26 in region 25 in FIG. 4. It is to be noted that region 25 includes walls 51, which may be embodied as turbulators, which encircle the longitudinal axis of the member 11. Fuel enters region 25, strikes the radially outermost wall 51, travels therearound, and then passes to the next radially outermost wall 51 which is on the opposite side of region 25 to the first struck wall 51, etc, thereby to follow a prolonged path that spirals inwardly. The liquid fuel will in this way be evaporated and a gas fuel resulting therefrom may be conveyed through the solid burner body member to enter said burner space 9 at 17 as pilot gas and/or through conveying means 27 to enter said space at 18 as main gas. Conversion of the liquid fuel to gas fuel, and the supply of this gas fuel to the main gas injecting members enables the main liquid fuel injectors 16 to be eliminated saving cost and complexity.

The internal passage 13 (including the region 25) is preferably also provided with other heat transfer enhancing means, such as turbulators. It may also be appropriate to design the inner wall surfaces thereof to prevent adhesion of fuel components thereto, such as by being smooth and/or having a repellent coating. It is preferred to use turbulators when using "pure" fuels, and the said coating when using "dirty" fuels. Within a range between these two extremes of fuel these two features may be combined.

Figure 4:
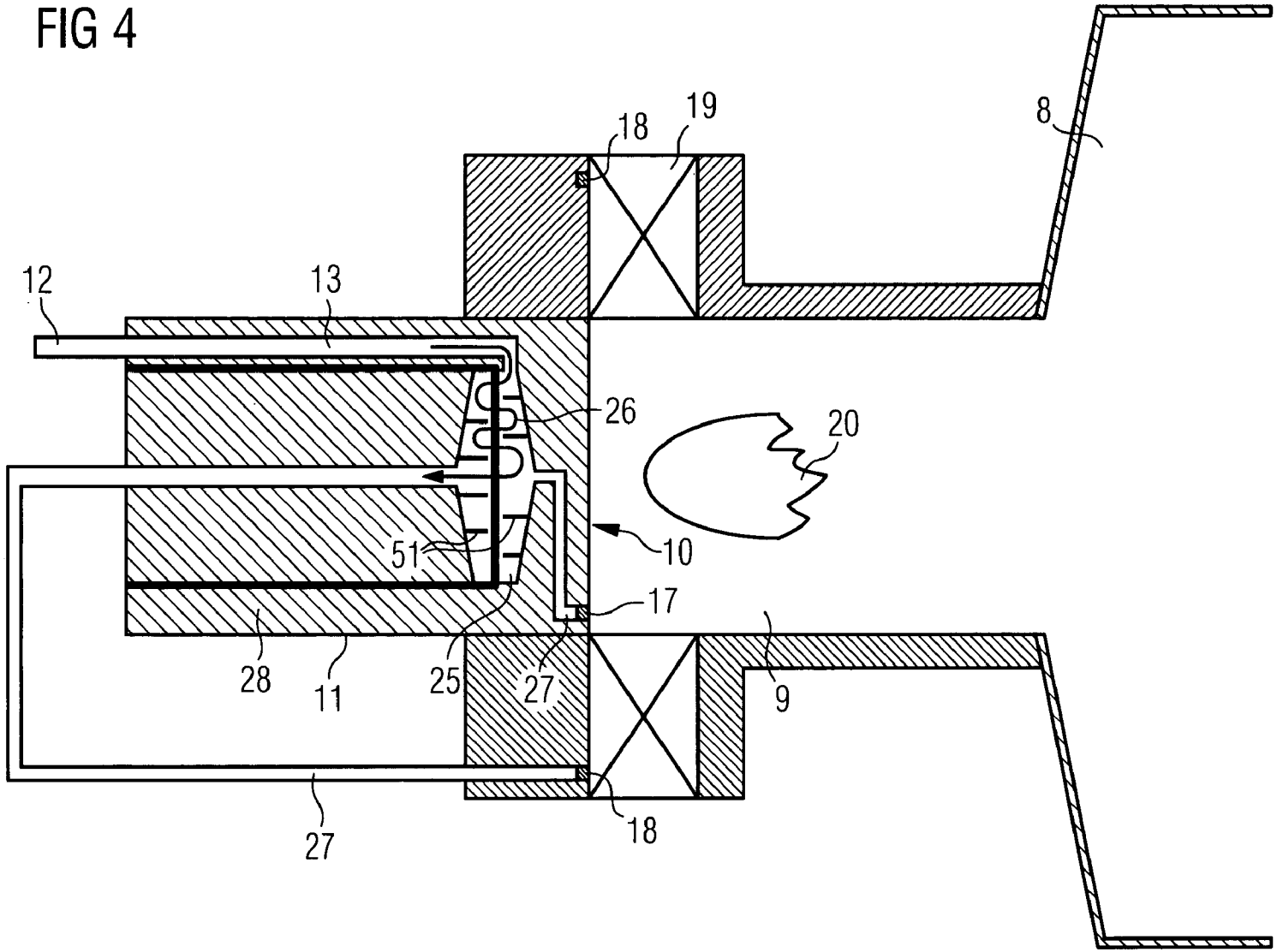
FIG. 4 is a schematic view illustrating an arrangement for preparation of a fuel for combustion according to a first embodiment of the present invention, FIG. **4*a* shows an arrangement according to the invention which is a modification of the embodiment shown in FIG. 4.

It is illustrated in FIG. 4 how said burner body may be designed to be allowed to be split according to a split surface 28 into at least two parts at a location enabling inspection and/or cleaning of surfaces of said internal passage, which in this case are the surfaces in the section 25 where the major part of the liquid fuel will be evaporated.

Figure 4A:
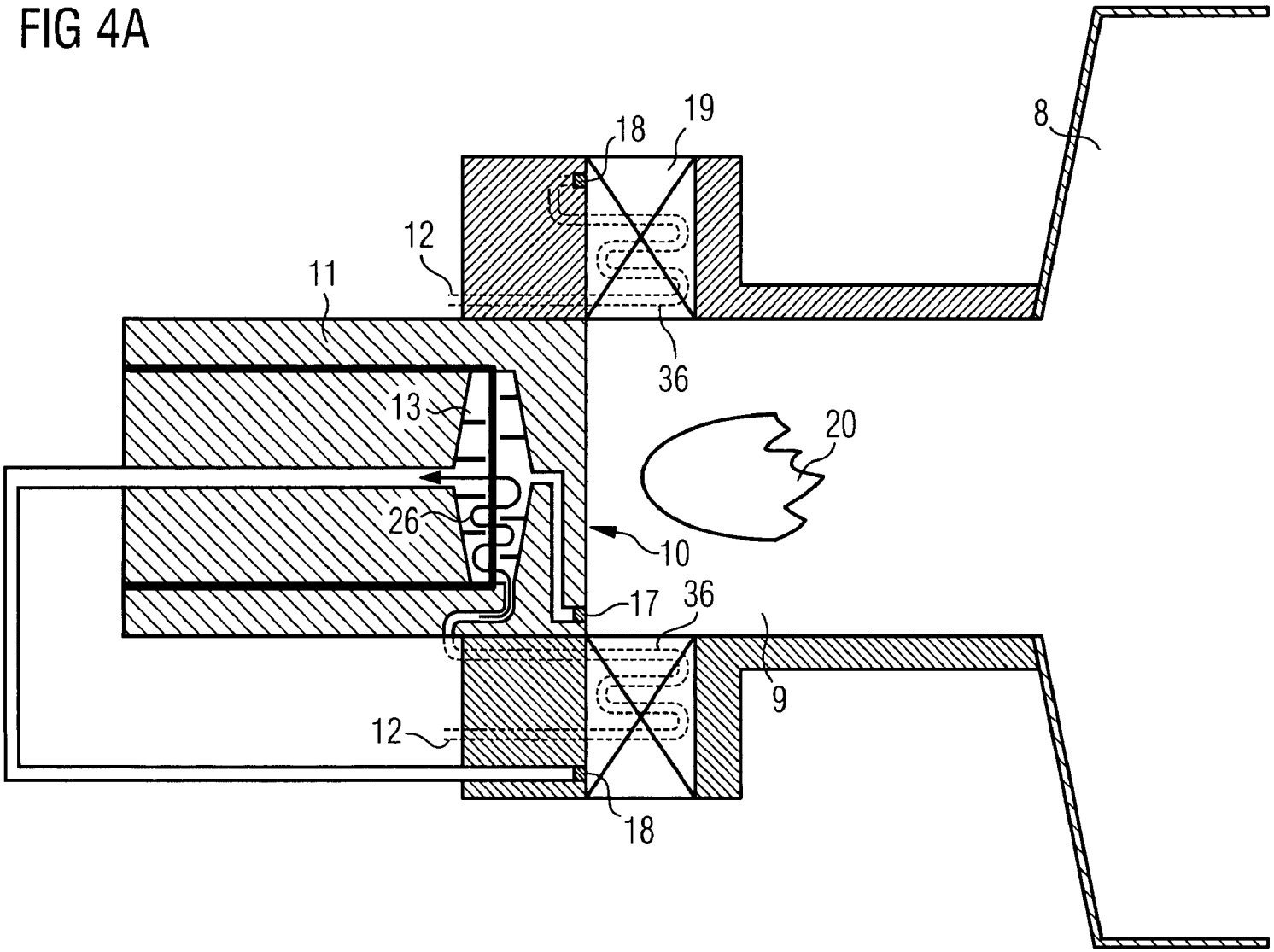

In FIG. 4*a* it is schematically indicated how a said internal passage 36 may also be arranged in said guide vanes 19 to conduct liquid fuel evaporated therein directly to the burner space 9 or to preheat this liquid fuel prior to it being passed to internal passage 13 to be fully evaporated therein. In this regard it is to be noted that energy to heat the liquid fuel can be derived from the pre-heated (compressed) air as well as from the flame 20. The preheated air will most likely be the dominant energy source for passages 36.

Figure 5:
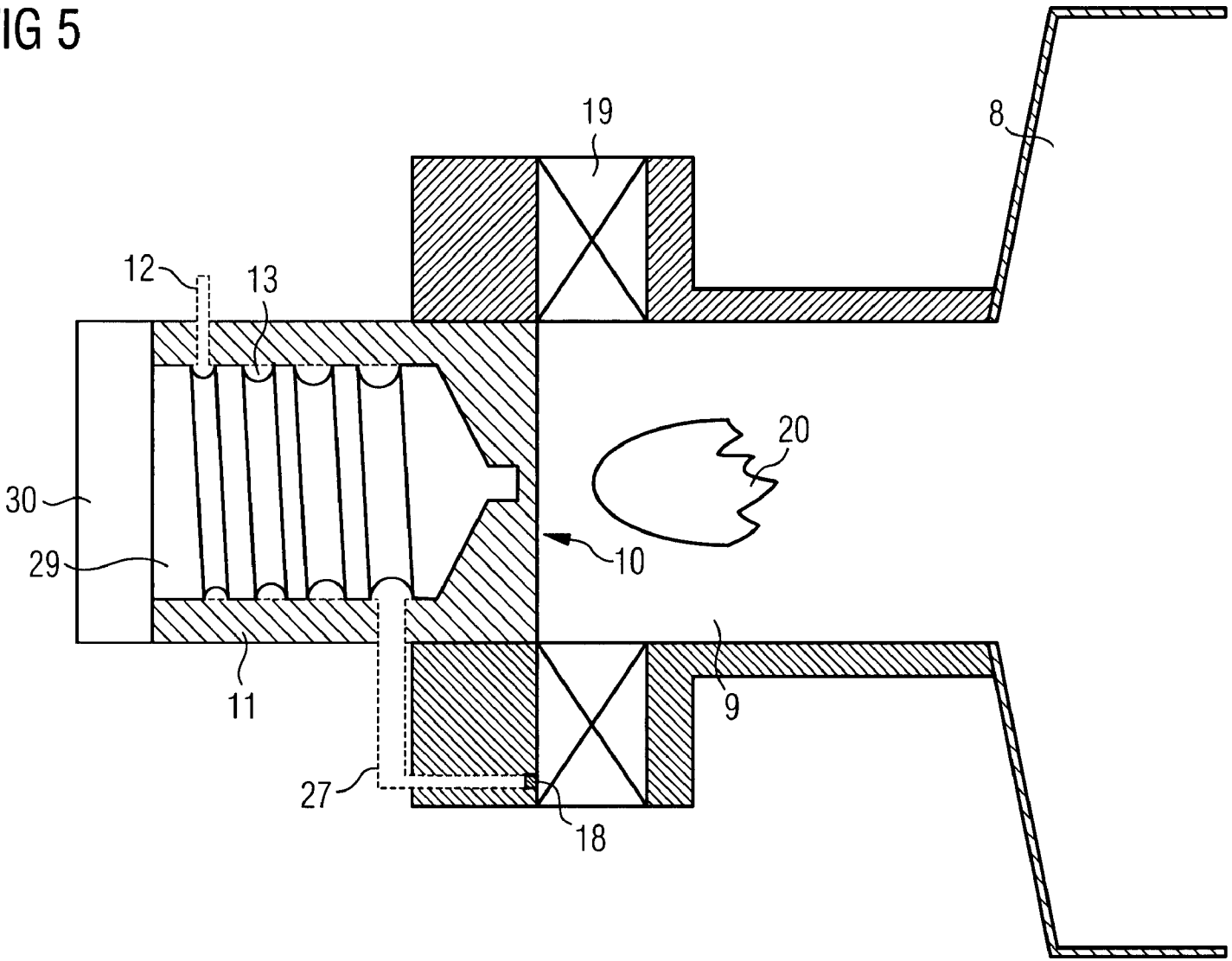
FIG. 5 is a schematic view of an arrangement according to a second embodiment of the present invention.

FIG. 5 illustrates a second embodiment of an arrangement according to the present invention comprising an insert member 29 containing at least the major part of said internal passage 13, which here extends according to a helical-like path for increasing the surface area for heat exchange. This insert may be removed from the solid burner body member 11, from which it is intended that the insert absorb the heat energy emanating from the flame 20. The removal may be accomplished by removing a lid-like member 30. The insert may then easily be taken out of the burner body member 11, since the connection of the supply means 12 is made so that no disconnection of the supply means is necessary for removal of the insert. The supply means 12 may of course be connected instead to the insert member 29 but this would then require disconnection for cleaning. The insert member is adapted to be in good contact with the burner body to obtain good heat transfer.

Figure 6:
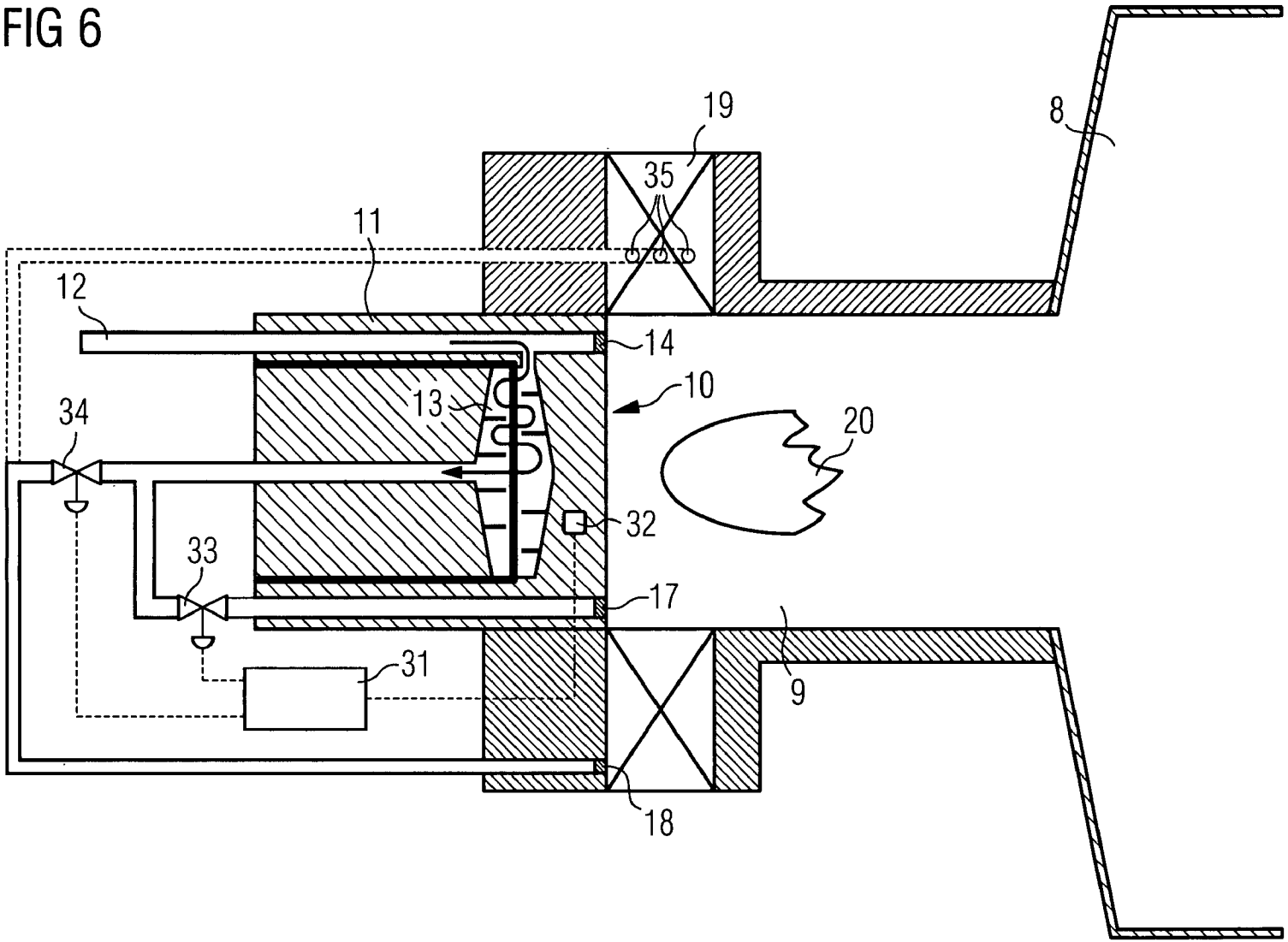
FIG. 6** is a schematic view illustrating an arrangement according to a third embodiment of the present invention.

FIG. 6 illustrates how the operation of the arrangement may be controlled upon start up of the burner. It is shown how liquid fuel is supplied at 12 to the internal passage 13 in the solid burner body member 11. Before the pilot burner end face 10 has had much exposure to the flame 20 and the temperature gradient has been built up, the fuel is injected as a liquid through the pilot nozzle 14. When the temperature in the pilot burner has increased sufficiently a control unit 31 receives information about the exceeding of a predetermined temperature level from a temperature sensor 32 adapted to measure the temperature of said solid burner body portions at least one location. The control unit 31 then opens a first valve means 33 to convey at least a part of the fuel evaporated in said internal passage to said pilot gas injector nozzles 17 as pilot gas. Liquid fuel may continue to be supplied to said burner space 9 through the nozzle 14.

The first valve means 33 could be located in the burner body and thermally-actuated. This would avoid the need for external control of the valve.

The arrangement comprises a further, second valve means 34 which communicates with said internal passage, and which comes into operation as the gas turbine engine accelerates and more fuel is required. The control unit 31 is adapted to begin to open said second valve means once a certain load on the arrangement is reached, and to assume a degree of opening corresponding to said load so as to convey at least a part of the fuel evaporated in said internal passage to said main gas injecting members at 18. It would also be possible to include a separate evaporator loop in the burner body member to feed the main gas injection.

FIG. 6 also schematically illustrates how fuel may be supplied to the burner space 9 at locations 35 axially distributed along the length of space 9.

The burner may also be provided with an auxiliary electrical evaporator element arranged to heat said internal passage 13 for producing the necessary evaporation energy until such time as the heat conducted from the flame 20 into the burner body member 11 is adequate for this purpose.

In the embodiments disclosed above a swirling effect is used to mix fuel and air and the burner is then in some sense round, implying a circumferential distribution of fuel to be preferable. However, if the fuel/air mixing is arranged for example through vortices the injection point of the fuel may be arranged radially or axially rather than circumferentially, as the shape of the burner in this case may be rectangular, such as squared.

The invention claimed is:

1. A premix burner arrangement, comprising:

a liquid fuel supply device that supplies a liquid fuel to the arrangement;

a combustion chamber;

a burner associated with the combustion chamber that combusts a fuel wherein the burner has:

a solid portion that receives heat from the burner operation, an internal passage arranged within the solid portion that connects to the liquid fuel supply device to convey the liquid fuel within the burner where the received heat of the solid portion is conveyed to the liquid fuel to create a vaporized fuel, wherein the internal passage has a portion that follows a path that spirals inwardly with respect to a longitudinal axis of the burner and that swirl is provided to the evaporated fuel and air by a swirler arranged upstream the combustion chamber, and a vaporized fuel conveying device that conveys the vaporized fuel for combustion within the chamber, wherein the internal passage has turbulators that enhance heat transfer to speed up the evaporation of the liquid fuel wherein the internal passage is arranged within a member of the burner body that forms a base of a burner space of the combustion chamber by an end face of the burner body, where a flame of the burner is operatively located and which extends from a base of the burner space towards the combustion chamber, wherein the arrangement further comprises a temperature sensor that measures the temperature of the solid burner body at least one location, a valve device in communication with the internal passage, and a control unit that, upon start up of the arrangement, keeps the valve device closed for injecting substantially all the fuel passing through the internal passage into the space through an injector device, and, when receiving information from the sensor that the temperature has exceeded a predetermined temperature level, opens the valve device to convey at least a portion of the fuel evaporated in the internal passage through a plurality of circumferentially distributed openings into the burner space, a plurality of main gas injecting members arranged adjacent to the burner space, and wherein the conveying device conveys at least a portion of the fuel evaporated in the internal passage to the space through the main gas injecting members, and wherein the valve device is adapted to open and close the fuel flow path to the main gas injecting members, the arrangement comprising a further valve device in communication with the internal passage, and where the control controls the further valve device to start to open at a certain load on the arrangement and to assume an opening degree varying with the load so as to convey at least a portion of the fuel evaporated in the internal passage to the main gas injecting members.

2. A premix burner arrangement, comprising:

a liquid fuel supply device that supplies a liquid fuel to the arrangement;

a combustion chamber;

a burner associated with the combustion chamber that combusts a fuel wherein the burner has:

a solid portion that receives heat from the burner operation, an internal passage arranged within the solid portion that connects to the liquid fuel supply device to convey the liquid fuel within the burner where the received heat of the solid portion is conveyed to the liquid fuel to create a vaporized fuel, wherein the internal passage has a portion that follows a path that spirals inwardly with respect to a longitudinal axis of the burner and that swirl is provided to the evaporated fuel and air by a swirler arranged upstream the combustion chamber, and a vaporized fuel conveying device that conveys the vaporized fuel for combustion within the chamber, wherein the internal passage is arranged within a member of the burner body that forms a base of a burner space of the combustion chamber by an end face of the burner body, where a flame of the burner is operatively located and which extends from a base of the burner space towards the combustion chamber, wherein the arrangement further comprises a temperature sensor that measures the temperature of the solid burner body at least one location, a valve device in communication with the internal passage, and a control unit that, upon start up of the arrangement, keeps the valve device closed for injecting substantially all the fuel passing through the internal passage into the space through an injector device, and, when receiving information from the sensor that the temperature has exceeded a predetermined temperature level, opens the valve device to convey at least a portion of the fuel evaporated in the internal passage through a plurality of circumferentially distributed openings into the burner space, a plurality of main gas injecting members arranged adjacent to the burner space, and wherein the conveying device conveys at least a portion of the fuel evaporated in the internal passage to the space through the main gas injecting members, and wherein the valve device is adapted to open and close the fuel flow path to the main gas injecting members, the arrangement comprising a further valve device in communication with the internal passage, and where the control controls the further valve device to start to open at a certain load on the arrangement and to assume an opening degree varying with the load so as to convey at least a portion of the fuel evaporated in the internal passage to the main gas injecting members.

3. The arrangement according to claim 2, wherein the burner body is constructed and arranged to be split into a plurality of parts at a location to facilitate inspection and/or cleaning of surfaces of the internal passage.

4. The arrangement according to claim 3, wherein at least one of the plurality of parts is removable from the remaining parts of the burner body for exposing the internal passage to facilitate inspection and/or cleaning of the internal passage, and the supply device is connected to a part of the burner body other than the at least one removable part.

5. The arrangement according to claim 4, wherein an insert member that at least partially forms the internal passage and the insert member is removably inserted in the solid portion of the burner body.

6. The arrangement according to claim 5, wherein the supply device is connected to the internal passage by the solid portion of the burner body which allows removal of the insert member from the burner body without disturbing the connection of the supply device to the burner body.

7. The arrangement according to claim 2, wherein the conveying device comprises an opening of the internal passage in the end face for injecting at least a portion of the evaporated fuel into the space by the injector device.

8. The arrangement according to claim 7, wherein the conveying device is adapted to convey at least a portion of the evaporated fuel in the internal passage to the space through openings into the space at a plurality of circumferentially distributed openings around the burner space.

9. The arrangement according to claim 8, wherein the circumferentially distributed openings are arranged in the end face.

10. The arrangement according to claim 9, wherein the conveying device conveys at least a portion of the evaporated fuel in the internal passage as the main fuel supply for the combustion to the burner space using the plurality of distributed openings.

11. The arrangement according to claim 10, wherein the conveying device conveys at least a portion of the evaporated fuel in the internal passage as the only fuel for the main fuel supply.

12. The arrangement according to claim 2, wherein the main gas injecting members are arranged circumferentially distributed around the burner space or axially distributed along the burner space.

13. The arrangement according to claim 12, wherein the conveying device conveys at least a portion of the evaporated fuel in the internal passage as the only gas fuel to enter the space through the main gas injecting members.

14. The arrangement according to claim 2, wherein the control unit is configured to open the valve device when the temperature sensor senses a temperature above 100° C.

15. The arrangement as claimed in claim 2 wherein a fuel mixing device for mixing fuel and an oxidant is disposed in the burner or combustion chamber.

16. The arrangement as claimed in claim 2 wherein at least a portion of the internal passage is provided with a surface to prevent adhesion of fuel components thereto.

* * * * *